US006428311B1

(12) United States Patent
Bernardo

(10) Patent No.: US 6,428,311 B1
(45) Date of Patent: Aug. 6, 2002

(54) CANDLE DEVICE FOR BURNING CANDLE WITHOUT A COTTON WICK

(76) Inventor: Jose Luis S. J. Bernardo, No. 40, Sec. 1, Yangshin Rd., Shinpu Jen Hsinchu County (TW)

( * ) Notice: Subject to any disclaimer, the term of this patent is extended or adjusted under 35 U.S.C. 154(b) by 0 days.

(21) Appl. No.: 09/653,323

(22) Filed: Sep. 1, 2000

(51) Int. Cl.[7] ..... F23D 3/16
(52) U.S. Cl. ..... 431/293; 431/289; 362/161
(58) Field of Search ..... 431/293, 292, 431/291, 320, 322, 288, 289, 298, 206, 205, 126; 362/161

(56) References Cited

U.S. PATENT DOCUMENTS

| | | | | | |
|---|---|---|---|---|---|
| 160,282 | A | * | 3/1875 | Rosengren | 431/205 |
| 192,294 | A | * | 6/1877 | Simmonds | 431/298 |
| 397,011 | A | * | 1/1889 | Leynen-Hougaerts | 431/298 |
| 1,184,511 | A | * | 5/1916 | Bourgeois | 431/320 |
| 3,048,025 | A | * | 8/1962 | Root | 431/293 |
| 3,183,688 | A | * | 5/1965 | Sobelson | 431/298 |
| 4,013,397 | A | * | 3/1977 | Neugart | 431/289 |
| 4,102,634 | A | * | 7/1978 | Crisp | 431/298 |
| 4,261,695 | A | * | 4/1981 | Reninger | 431/320 |
| 4,934,924 | A | * | 6/1990 | Nakai | 431/325 |

FOREIGN PATENT DOCUMENTS

| | | | | | |
|---|---|---|---|---|---|
| DE | 592 429 | A | * | 1/1934 | 431/298 |
| FR | 2 692 654 | A1 | * | 12/1993 | 431/298 |
| GB | 6152 | A | * | 2/1897 | 431/298 |

* cited by examiner

*Primary Examiner*—Henry Bennett
*Assistant Examiner*—Josiah C. Cocks
(74) *Attorney, Agent, or Firm*—Dennison, Schultz & Dougherty

(57) ABSTRACT

The present invention proposes a candle device for burning a candle without a cotton wick. The candle device is directly placed on a candle without a cotton wick so that the candle can be lighted and burned successfully. The candle device comprises a heater, a lighting wick, and a float bowl. The heater is a hollow tube with a small tube of a smaller diameter shrinking from the lower section thereof. A fixing structure is formed near the bottom end of the small tube. The lighting wick is arranged in the small tube of the heater and extends to the upper opening of the tube. The float bowl is fixedly installed on the periphery of the bottom end of the small tube of the heater via the fixing structure. The present invention has the advantages of no candle drops, wax saving, complete burning, and no black smoke. Moreover, the candle device of the present invention can be used repeatedly.

1 Claim, 3 Drawing Sheets

CANDLE DEVICE FOR BURNING CANDLE WITHOUT A COTTON WICK

FIELD OF THE INVENTION

The present invention relates to a candle device and, more particularly, to a candle device for burning a candle without a cotton wick so that the effect of environmental protection can be achieved.

BACKGROUND OF THE INVENTION

Religious faith is the settling place of human spirit and soul. No matter believing in what religion, it is common to burn candles for worship or sacrificing the gods and ancestors. Moreover, people usually burn delicate candles at home to enhance savor of lives.

Prior art candles can be categorized into two types. The first type of candle is the solid candle bar, which is formed by arranging a cotton wick at the center of a solid wax bar so that the candle can be lighted and burned through the help of the cotton wick. However, candle drops may be easily generated when the candle is burned, resulting in waste of wax material. Also, black smoke generated when burning the cotton wick may result in air pollution. The other type of candle is the liquid candle, which is formed by placing liquid wax in a vessel and arranging a cotton wick in the liquid wax. Although candle drops will not be generated, black smoke generated when burning the cotton wick can not be avoided.

The present invention aims to provide a candle device for burning a candle without a cotton wick to resolve the above problems.

SUMMARY AND OBJECTS OF THE PRESENT INVENTION

The primary object of the present invention is to provide a candle device for burning a candle without a cotton wick. The present invention has the advantages of no candle drops, wax saving, complete burning, and no black smoke so that the effect of environmental protection can be achieved.

Another object of the present invention is to provide a candle device for burning a candle without a cotton wick, which device is applicable to various kinds of candles such as the solid candle bar or the liquid candle.

Yet another object of the present invention is to provide a candle device for burning a candle without a cotton wick, which device can reduce the cost and be used repeatedly.

According to the present invention, a candle device for burning a candle without a cotton wick comprises a heater, a lighting wick, and a float bowl. The heater is a hollow tube with a small tube of a smaller diameter shrinking from the lower section thereof. A projective ring is formed near the bottom end of the small tube. The lighting wick is arranged in the small tube of the heater and extends to the upper opening of the tube. The float bowl is fastened at the projective ring of the small tube of the heater and is fixed on the periphery of the small tube via a packing ring.

The various objects and advantages of the present invention will be more readily understood from the following detailed description when read in conjunction with the appended drawings, in which:

DETAILED DESCRIPTION OF PREFERRED EMBODIMENT

The present invention is characterized in that a candle device is placed on a candle without a cotton wick so that the candle can be burned continually. The function of the cotton wick can be completely replaced to achieve better effect.

Figure 1:
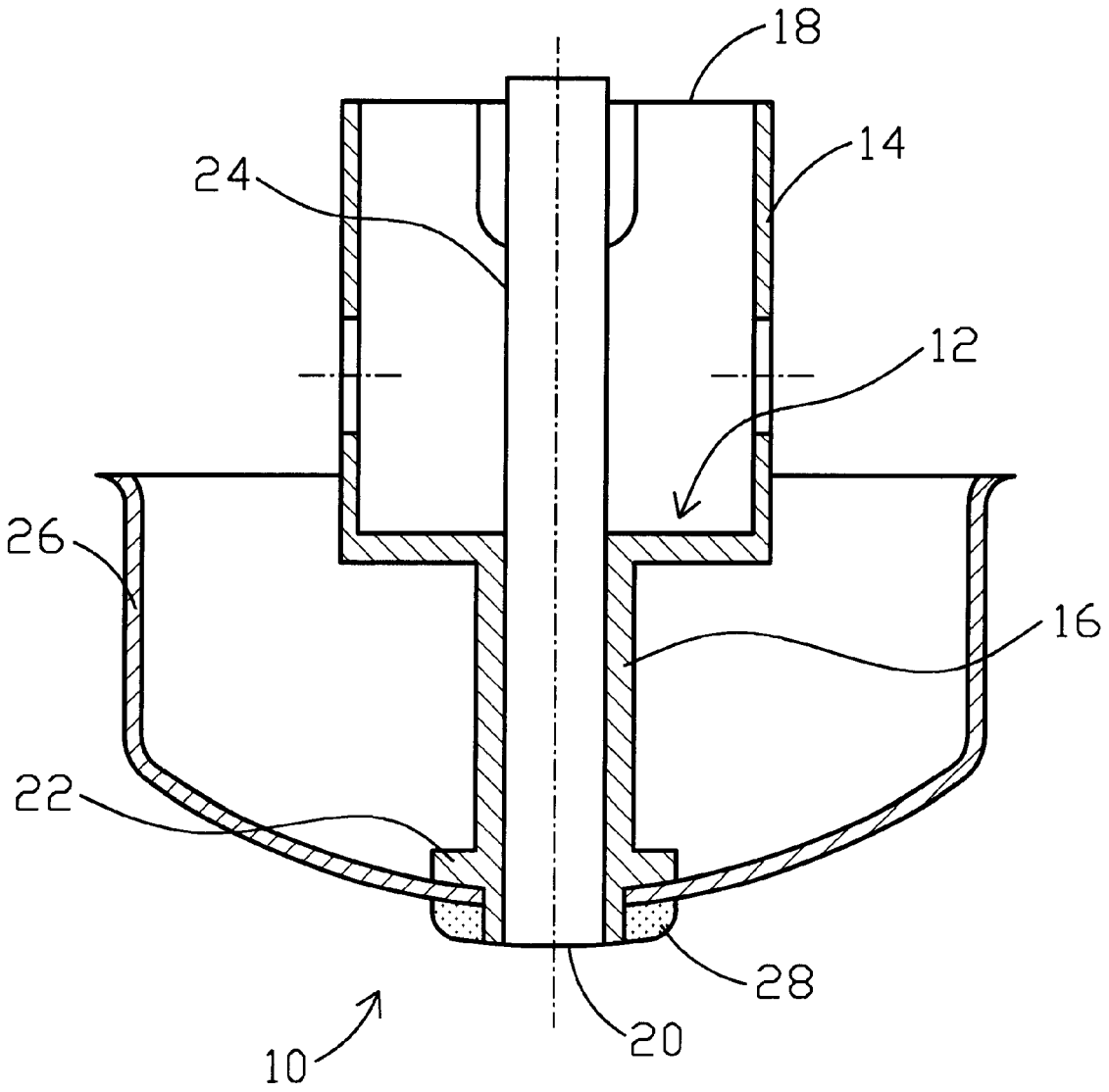
FIG. 1 is a cross-sectional view of a candle device for burning a candle without a cotton wick according to an embodiment of the present invention.

As shown in FIG. 1, a candle device can be directly placed on a candle without a cotton wick to let the candle be burned continually so that the function of the prior art cotton wick can be completely replaced. The candle device 10 for burning a candle without a cotton wick comprises a heater 12, a lighting wick 24, and a float bowl 26. The heater 12 is a hollow tube 14 with a small tube 16 of a smaller diameter shrinking from the lower section thereof. The opening near the tube 14 is the upper opening 18, while the opening near the small tube 16 is the lower opening 20. A fixing structure, being a projective ring 22, is formed near the bottom end of the small tube 16. The lighting wick 24 formed by winding stainless steel net is arranged exactly in the small tube 16 of the heater 12 and extends to the upper opening 18 of the tube 14. The float bowl 26 is fastened on the periphery of the lower opening 20 at the bottom end of the small tube 16 of the heater 12 via the projective ring 22 and is exactly fixed on the small tube 16 via a packing ring 28.

Figure 2:
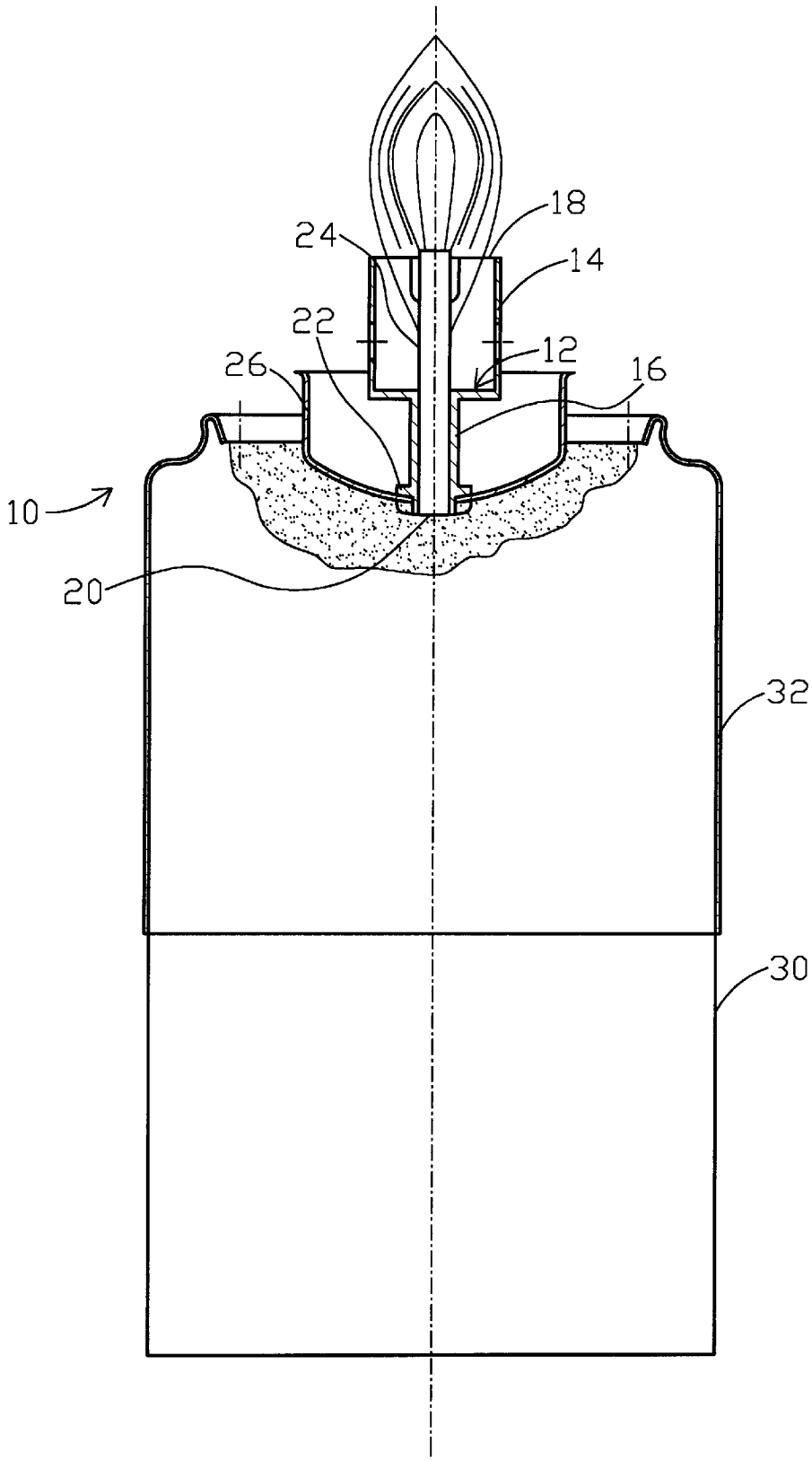
FIG. 2 is a cross-sectional view of a candle device for burning a candle without a cotton wick according to another embodiment of the present invention.

The above candle device can be directly placed on a solid candle bar or liquid candle without a cotton wick. Moreover, as shown in FIG. 2, an outer housing 32 can be installed on the outer periphery of the float bowl 26 so that the candle device 10 can be conveniently mounted on a solid candle 30 without a cotton wick. The size and shape of the outer housing 32 can vary so that the outer housing 32 can be telescope on various kinds of candles 30 successfully.

The present invention will be illustrated with reference to FIG. 2. The outer housing 32 is directly telescoped on the candle 30. The heater 12 on the float bowl 26 is heated for several tens of seconds by a lighter when lighting the candle 30 so that the heater 12 can conduct heat downwards to let the wax exactly below it begin to melt. Vaporization of wax will happen when the temperature reaches about 60 degrees of centigrade. Wax vapor will enter the lighting wick 24 via the lower opening 20 and be burned at the lighting wick 24 made of metal net. Vaporization of wax of the candle 30 will happen continually so that phenomenon of burning can be maintained. Therefore, the function of the cotton wick of a prior art candle can be completely replaced. Additionally, because the wax below the heater 12 is liquid, the float bowl 26 is exploited to prevent the heater 12 from sinking. When the candle is burned out, the candle device can be placed on another candle without a cotton wick. That is, the present invention can be used repeatedly.

Figure 3:
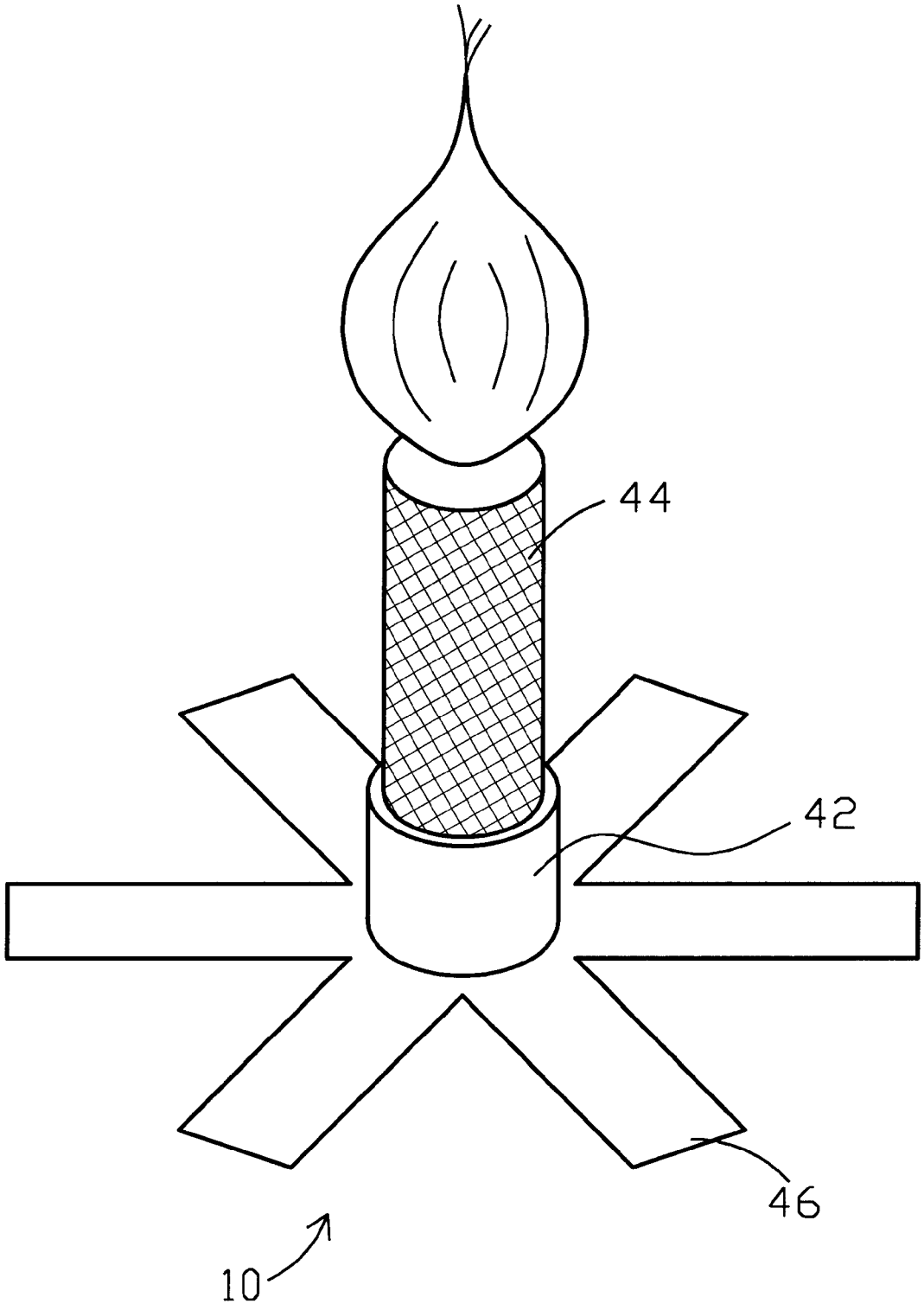
FIG. 3 shows a top view and a perspective view of a candle device for burning a candle without a cotton wick according to yet another embodiment of the present invention.

FIG. 3 shows yet another embodiment of the present invention. A candle device 40 for burning a candle without a cotton wick comprises a heater 42, a lighting wick 44, and a float board 46. The heater 42 is a hollow tube. The lighting wick 44 is arranged in the heater 42 and extends out from the upper opening thereof. The float board 46 is vertically fixed on the periphery of the bottom end of the heater 42 and can be of various kinds of shapes. The float board 46 is directly placed on a candle 30 without a cotton wick. Because the principle of burning is the same as that stated above, it will not be further illustrated.

To sum up, the present invention provides a candle device for burning a candle without a cotton wick. The present invention has the advantages of no candle drops, wax saving, complete burning, and no black smoke so that the effect of environmental protection can be achieved. Moreover, the present invention can reduce the cost and be used repeatedly.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

I claim:

1. A candle device for burning a candle without a cotton wick, said candle device being directly placed on a candle without a cotton wick, said candle device comprising:

a float bowl having a top, a bottom portion and an outer periphery;

a heater including a first hollow tube having an upper opening and a lower section and a small tube of a smaller diameter than said first hollow tube extending downwardly from said lower section of said first hollow tube and said small tube having a bottom end;

a lighting wick formed of a winding of stainless steel net disposed in said small tube of said heater and extending to said upper opening of said first hollow tube; and, a fixing structure including an outwardly projecting ring and a packing ring formed at said bottom end of said small tube for fixing said bottom portion of said float bowl to said bottom end of said small tube with said first hollow tube extending upwardly above said top of said float bowl; and, an outer housing disposed around said outer periphery of said float bowl and extending downwardly and over a candle so that the candle device can be mounted on a solid candle without a cotton wick, whereby the candle can be lighted and burned.

* * * * *